US009890337B2

(12) United States Patent
Corscadden et al.

(10) Patent No.: US 9,890,337 B2
(45) Date of Patent: Feb. 13, 2018

(54) OPTIMAL ASPHALTENE CONVERSION AND REMOVAL FOR HEAVY HYDROCARBONS

(71) Applicant: MEG ENERGY CORP., Calgary (CA)

(72) Inventors: Tom Corscadden, Calgary (CA); Jim Kearns, Calgary (CA); Greg Diduch, Calgary (CA); Damien Hocking, Calgary (CA); Darius Remesat, Calgary (CA)

(73) Assignee: MEG ENERGY CORP., Calgary (CA)

( * ) Notice: Subject to any disclaimer, the term of this patent is extended or adjusted under 35 U.S.C. 154(b) by 0 days.

(21) Appl. No.: 15/276,224

(22) Filed: Sep. 26, 2016

(65) Prior Publication Data

US 2017/0029721 A1 Feb. 2, 2017

Related U.S. Application Data

(62) Division of application No. 13/037,185, filed on Feb. 28, 2011, now Pat. No. 9,481,835.

(Continued)

(51) Int. Cl.

| | |
|---|---|
| ***C10G 55/04*** | (2006.01) |
| ***C10G 21/00*** | (2006.01) |
| ***C10G 53/04*** | (2006.01) |

(52) U.S. Cl.

CPC ..... *C10G 55/04* (2013.01); *C10G 21/003* (2013.01); *C10G 53/04* (2013.01); *C10G 2300/1033* (2013.01)

(58) Field of Classification Search

CPC ..... C10G 55/04; C10G 21/003; C10G 53/04; C10G 2300/1033

See application file for complete search history.

(56) References Cited

U.S. PATENT DOCUMENTS

| | | | |
|---|---|---|---|
| 2,493,265 | A | 1/1950 | Scheibel |
| 2,850,431 | A | 9/1958 | Smith |

(Continued)

FOREIGN PATENT DOCUMENTS

| | | | |
|---|---|---|---|
| CA | 2455149 | A1 | 6/2004 |
| CA | 2764676 | C | 8/2012 |

(Continued)

OTHER PUBLICATIONS

Beuther et al., "Thermal Visbreaking of Heavy Residues", The Oil and Gas Journal. 57:46, Nov. 9, 1959, pp. 151-157.

(Continued)

*Primary Examiner* — Randy Boyer
*Assistant Examiner* — Juan Valencia
(74) *Attorney, Agent, or Firm* — Bennett Jones LLP

(57) ABSTRACT

The invention provides improved apparatus and method for producing a pipeline-ready or refinery-ready feedstock from heavy, high asphaltene crude, comprising a pre-heater for pre-heating a process fluid to a design temperature at or near the operating temperature of a reactor; moving the process fluid into the reactor for conversion of the process fluid by controlled application of heat to the process fluid in the reactor so that the process fluid maintains a substantially homogenous temperature to produce a stream of thermally affected asphaltene-rich fractions, and a stream of vapor. The stream of vapor is separated into two further streams: of non-condensable vapor, and of light liquid hydrocarbons. The thermally affected asphaltene-rich fraction is deasphalted using a solvent extraction process into streams of heavy deasphalted oil liquid, and concentrated asphaltene, respectively. The deasphalted oil liquid and the light liquid hydrocarbons produced are blended to form a pipeline or refinery-ready feedstock.

10 Claims, 4 Drawing Sheets

Related U.S. Application Data

(60) Provisional application No. 61/309,556, filed on Mar. 2, 2010.

(56) References Cited

U.S. PATENT DOCUMENTS

| | | | | |
|---|---|---|---|---|
| 3,005,769 | A | 10/1961 | Garwin | |
| 3,053,751 | A | 9/1962 | Garwin | |
| 3,318,804 | A | 5/1967 | Van Pool et al. | |
| 3,516,928 | A | 6/1970 | King et al. | |
| 3,714,033 | A | 1/1973 | Somekh et al. | |
| 3,714,034 | A | 1/1973 | Kosseim et al. | |
| 3,779,902 | A | 12/1973 | Mitchell et al. | |
| 3,811,843 | A | 5/1974 | Morfit et al. | |
| 3,847,751 | A | 11/1974 | Godino et al. | |
| 3,968,023 | A | 7/1976 | Yan | |
| 4,017,383 | A | 4/1977 | Beavon | |
| 4,062,758 | A | 12/1977 | Goudriaan et al. | |
| 4,088,540 | A | 5/1978 | Bunas | |
| 4,101,415 | A | 7/1978 | Crowley et al. | |
| 4,125,458 | A | 11/1978 | Bushnell et al. | |
| 4,191,636 | A | 3/1980 | Fukui et al. | |
| 4,200,525 | A | 4/1980 | Karr | |
| 4,233,138 | A | 11/1980 | Rollmann et al. | |
| 4,239,616 | A | 12/1980 | Gearhart | |
| 4,260,476 | A | 4/1981 | Vidueira et al. | |
| 4,278,529 | A | 7/1981 | Gearhart | |
| 4,389,302 | A | 6/1983 | Garwin et al. | |
| 4,421,639 | A | 12/1983 | Lambert et al. | |
| 4,428,824 | A | 1/1984 | Choi et al. | |
| 4,454,023 | A * | 6/1984 | Lutz | C10G 67/049 208/106 |
| 4,455,216 | A | 6/1984 | Angevine et al. | |
| 4,482,453 | A | 11/1984 | Coombs et al. | |
| 4,528,100 | A | 7/1985 | Zarchy | |
| 4,530,754 | A | 7/1985 | Shiroto et al. | |
| 4,572,781 | A | 2/1986 | Krasuk et al. | |
| 4,640,762 | A | 2/1987 | Woods et al. | |
| 4,673,485 | A | 6/1987 | Bristow et al. | |
| 4,686,028 | A | 8/1987 | Van Driesen et al. | |
| 4,767,521 | A | 8/1988 | Feldman et al. | |
| 4,773,986 | A | 9/1988 | Feldman et al. | |
| 4,778,586 | A | 10/1988 | Bain et al. | |
| 4,810,367 | A | 3/1989 | Chombart et al. | |
| 4,818,371 | A | 4/1989 | Bain et al. | |
| 4,846,958 | A | 7/1989 | Feldman et al. | |
| 4,882,035 | A | 11/1989 | Loutaty et al. | |
| 4,940,529 | A | 7/1990 | Beaton et al. | |
| 4,994,172 | A | 2/1991 | Buchanan et al. | |
| 5,008,085 | A | 4/1991 | Bain et al. | |
| 5,009,772 | A | 4/1991 | Nelson et al. | |
| 5,013,427 | A | 5/1991 | Mosby et al. | |
| 5,124,025 | A | 6/1992 | Kolstad et al. | |
| 5,124,026 | A | 6/1992 | Taylor et al. | |
| 5,124,027 | A | 6/1992 | Beaton et al. | |
| 5,188,709 | A | 2/1993 | Kuerston et al. | |
| 5,192,421 | A | 3/1993 | Audeh et al. | |
| 5,228,978 | A | 7/1993 | Taylor et al. | |
| 5,242,578 | A | 9/1993 | Taylor et al. | |
| 5,258,117 | A | 11/1993 | Kolstad et al. | |
| 5,601,697 | A | 2/1997 | Miller et al. | |
| 5,635,055 | A | 6/1997 | Sweet et al. | |
| 5,667,686 | A | 9/1997 | Schubert | |
| 5,795,464 | A | 8/1998 | Sankey et al. | |
| 5,919,355 | A | 7/1999 | Hood | |
| 5,932,090 | A | 8/1999 | Marachionna et al. | |
| 5,976,360 | A | 11/1999 | Blum et al. | |
| 5,976,361 | A | 11/1999 | Hood et al. | |
| 6,183,627 | B1 | 2/2001 | Friday et al. | |
| 6,210,560 | B1 | 4/2001 | Wiehe et al. | |
| 6,274,003 | B1 | 8/2001 | Friday et al. | |
| 6,274,032 | B2 | 8/2001 | Hood et al. | |
| 6,357,526 | B1 | 3/2002 | Abdel-Halim et al. | |
| 6,524,469 | B1 | 2/2003 | Schucker | |
| 6,533,925 | B1 | 3/2003 | Wallace et al. | |
| 6,540,918 | B2 | 4/2003 | Gil et al. | |
| 6,972,085 | B1 | 12/2005 | Brecher et al. | |
| 7,297,250 | B2 | 11/2007 | Bronicki | |
| 7,381,320 | B2 | 6/2008 | Iqbal et al. | |
| 7,582,204 | B2 | 9/2009 | Gueret et al. | |
| 7,585,407 | B2 | 9/2009 | Duyvesteyn et al. | |
| 7,597,794 | B2 | 10/2009 | Zhao et al. | |
| 7,691,256 | B2 | 4/2010 | Montanari et al. | |
| 7,718,839 | B2 | 5/2010 | Baumgartner et al. | |
| 7,749,378 | B2 | 7/2010 | Iqbal et al. | |
| 7,758,746 | B2 | 7/2010 | Yeggy et al. | |
| 7,799,207 | B2 | 9/2010 | Allinson et al. | |
| 7,837,859 | B2 | 11/2010 | Ou et al. | |
| 7,867,385 | B2 | 1/2011 | Yeggy et al. | |
| 7,964,090 | B2 | 6/2011 | Iqbal | |
| 7,976,695 | B2 | 7/2011 | Brecher | |
| 8,048,291 | B2 | 11/2011 | Subramanian et al. | |
| 8,252,179 | B2 | 8/2012 | Aoki et al. | |
| 9,085,499 | B2 | 7/2015 | Frey et al. | |
| 2001/0002654 | A1 | 6/2001 | Hood et al. | |
| 2003/0019790 | A1 | 1/2003 | Schucker | |
| 2003/0089636 | A1 | 5/2003 | Marchionna et al. | |
| 2003/0129109 | A1 | 7/2003 | Bronicki | |
| 2004/0163996 | A1 | 8/2004 | Colyar | |
| 2006/0032789 | A1 | 2/2006 | Bronicki | |
| 2006/0272982 | A1 | 12/2006 | Montanari et al. | |
| 2007/0125686 | A1 | 6/2007 | Zheng et al. | |
| 2008/0083652 | A1 | 4/2008 | Morel et al. | |
| 2008/0093259 | A1 | 4/2008 | Brecher | |
| 2009/0101540 | A1 | 4/2009 | Marchionna et al. | |
| 2009/0166253 | A1 | 7/2009 | Subramanian et al. | |
| 2009/0166254 | A1 | 7/2009 | Subramanian et al. | |
| 2010/0243518 | A1 | 9/2010 | Zimmerman et al. | |
| 2010/0300931 | A1 | 12/2010 | Barrero et al. | |
| 2010/0300934 | A1 | 12/2010 | Marchionna et al. | |
| 2011/0005970 | A1 | 1/2011 | Ou et al. | |
| 2011/0011720 | A1 | 1/2011 | Rinker | |
| 2011/0017642 | A1 | 1/2011 | Duyvesteyn | |
| 2011/0028573 | A1 | 2/2011 | Hassan et al. | |
| 2011/0061298 | A1 | 3/2011 | Frey et al. | |
| 2011/0215030 | A1 | 9/2011 | Corscadden | |
| 2011/0266198 | A1 | 11/2011 | Hassan et al. | |
| 2013/0081325 | A1 | 4/2013 | Corscadden et al. | |
| 2013/0098735 | A1 | 4/2013 | Corscadden et al. | |
| 2013/0180888 | A1 | 7/2013 | Corscadden et al. | |
| 2013/0266556 | A9 | 10/2013 | Medoff | |

FOREIGN PATENT DOCUMENTS

| | | | |
|---|---|---|---|
| CN | 1410510 | A | 4/2003 |
| CN | 1485412 | A | 3/2004 |
| CN | 1729275 | A | 2/2006 |
| CN | 1891784 | A | 1/2007 |
| CN | 101045872 | A | 10/2007 |
| CN | 101952395 | A | 1/2011 |
| RU | 2124040 | | 12/1998 |
| WO | WO 2007/103005 | A1 | 9/2007 |
| WO | WO 2008/106765 | A1 | 9/2008 |
| WO | WO 2010/060092 | A2 | 5/2010 |
| WO | WO 2011/062737 | | 5/2011 |
| WO | WO 2011/084564 | A2 | 7/2011 |
| WO | WO 2011/106878 | A1 | 9/2011 |
| WO | WO 2013/044346 | A1 | 4/2013 |

OTHER PUBLICATIONS

Rhoe et al., "Visbreaking: A Flexible Process", Hydrocarbon Processing, Jan. 1979, pp. 131-136.

Golden and Barletta, "Designing Vacuum Units" (for Canadian heavy crudes), Petroleum Technology Quarterly, Q2, 2006, pp. 105-110.

R. Ulrich et al., "Application of the Rotating Disk Method to the Study of Bitumen Dissolution into Organic Solvents", Canadian Journal of Chemical Engineering, vol. 69, Aug. 1991.

Engineering ToolBox, "Ethane", no date.

ChemEd DL, "Viscosity", Dec. 16, 2010.

(56) References Cited

OTHER PUBLICATIONS

Thermodedia, "Pentane", Feb. 2, 2011.

* cited by examiner

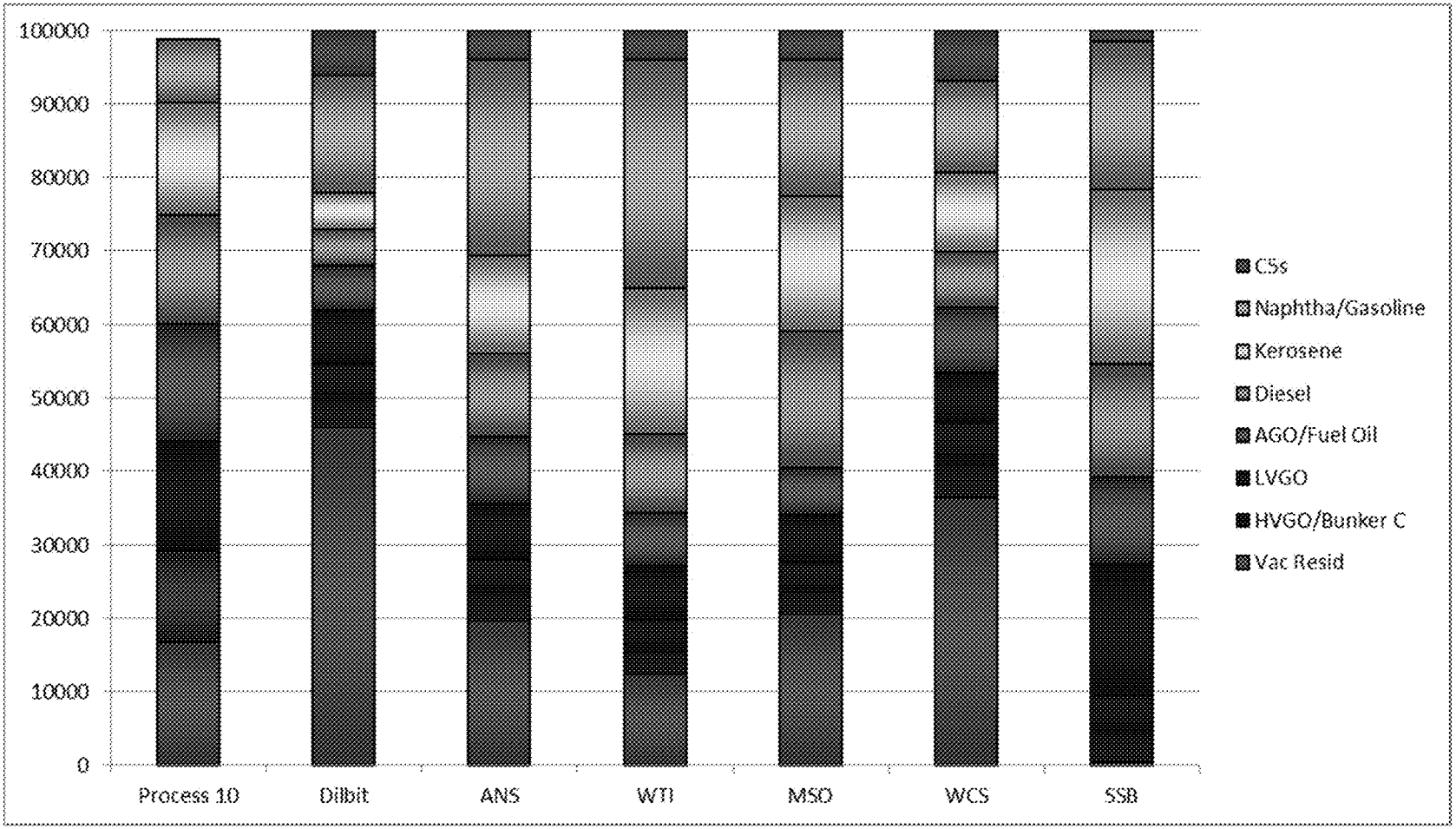
*Fig. 4 – Distillation analysis for various crudes including Process 10 Product*

OPTIMAL ASPHALTENE CONVERSION AND REMOVAL FOR HEAVY HYDROCARBONS

The present invention relates to a method of improving a heavy hydrocarbon, such as bitumen, to a lighter more fluid product and, more specifically, to a final hydrocarbon product that is refinery-ready and/or meets pipeline transport criteria without the addition of diluent. It is targeted to enhance Canadian bitumen, but has general application in improving any heavy hydrocarbon.

BACKGROUND OF THE INVENTION

Sweet crude resources require less capital input for refining, and have a much lower cost of processing than heavy sour crudes. However, the global availability of light, sweet crude to supply to refineries for the production of transportation fuels is on the decline making the processing of heavy sour crude an increasingly important option to meet the world's demand for hydrocarbon-based fuels.

Most (if not all) commercial upgraders for processing heavy crude have been built to convert heavy viscous hydrocarbons into crude products that range from light sweet to medium sour blends. Heavy oil upgraders basically achieve this by high intensity conversion processes which either release up to 20% by weight of the feedstock as a coke byproduct and another 5% as off-gas product, or require hydro-processing such as hydrocracking and hydro-treating to maximize the conversion of the heavy components in the feedstock to lighter, lower sulfur liquid products and gas.

DESCRIPTION OF PRIOR ART

Processes have been disclosed to convert and/or condition Oil Sands bitumen into pipeline transportable and refinery acceptable crude. Of note, thermal cracking, catalytic cracking, solvent deasphalting and combinations of all three (for example, visbreaking and solvent deasphalting) have been proposed to convert bitumen to improve its characteristics for transport and use as a refinery feedstock.7

Thermal Cracking

Visbreaking or viscosity breaking, a form of thermal cracking, is a well known petroleum refining process in which heavy and/or reduced crudes are pyrolyzed, or cracked, under comparatively mild conditions to provide products that have lower viscosities and pour points, thus reducing required amounts of less-viscous and increasingly costly to obtain blending hydrocarbons known as diluent to improve fluidity of the crude, and make the crude meet minimum transport pipeline specifications (minimum API gravity of 19).

There are two basic visbreaking configurations, the coil-only visbreaker and the coil-and-soak visbreaker. Both require heaters to heat the crude, with the coil-only style employing cracking only in the heater tubes. Coil-only visbreakers operate at about 900° F. at the heater outlet with a residence time of about 1 minute. Gas oil is recycled to quench the reaction. In the coil-and-soak visbreaker, a vessel is used at the outlet of a furnace to provide additional residence time for cracking of the crude. The crude sits and continues to crack/react as the temperature slowly reduces. The coil-and-soak visbreaker runs at heater outlet temperatures of 800° F. The soaker drum temperature reduces down to 700° F. at the outlet with aggregate residence times of over 1 hour.

Examples of such visbreaking methods are described in Beuther et al., "Thermal Visbreaking of Heavy Residues", The Oil and Gas Journal. 57:46, Nov. 9, 1959, pp. 151-157; Rhoe et al., "Visbreaking: A Flexible Process", Hydrocarbon Processing, January 1979, pp. 131-136; and U.S. Pat. No. 4,233,138. The yield structure is approximately same for either configuration: 1-3% light ends, 5% (wt) naphtha and 15% (vt) gas oil. The remainder remains as heavy oil or bitumen. The products are separated in a distillation column for further processing or blending.

A concern with standard visbreaking schemes is that for Canadian Bitumen, the operating temperatures are above the limit (around 700° F.-720° F.) where significant coking impacts operability (Golden and Bartletta, Designing Vacuum Units (for Canadian heavy crudes), Petroleum Technology Quarterly, Q2, 2006, pp. 105). In addition, heat is added over a short period of time in the heater, so local heat fluxes are not uniform and can peak well above coking initiation limits; and the heat is not maintained consistently allowing for condensation reactions to occur. Attempting to apply conventional visbreaking to Canadian Bitumen is limited due to the propensity for coking and inability of these systems to manage this issue.

In the first part of U.S. Pat. No. 6,972,085 and in patent application US2008/0093259 an attempt is made to address the desire for a constant and sustained application of heat to the crude over an extended period of time. Essentially, the heater and the holding vessel are merged into one vessel to create a continuous heated bath for the crude. Multiple heating levels are applied to the crude at various times. This is an improvement over standard visbreaking but does not eliminate hot spots within the processed crude, permitting coking due to temperature peaks above optimal levels for cracking.

Combination of Thermal/Catalytic Cracking and Solvent Deasphalting

In U.S. Pat. No. 4,454,023 a process for the treatment of heavy viscous hydrocarbon oil is disclosed, the process comprising the steps of: visbreaking the oil; fractionating the visbroken oil; solvent deasphalting the non-distilled portion of the visbroken oil in a two-stage deasphalting process to produce separate asphaltene, resin, and deasphalted oil fractions; mixing the deasphalted oil ("DAO") with the visbroken distillates; and recycling and combining resins from the deasphalting step with the feedstock initially delivered to the visbreaker. The U.S. '023 patent provides a means for upgrading lighter hydrocarbons (API gravity>15) than Canadian Bitumen but is burdened by the misapplication of the thermal cracking technology that will over-crack and coke the hydrocarbon stream, and by the complexity and cost of a two-stage solvent deasphalting system to separate the resin fraction from the deasphalted oil. In addition, the need to recycle part of the resin stream increases the operating costs and complexity of operation.

In U.S. Pat. No. 4,191,636, heavy oil is continuously converted into asphaltenes and metal-free oil by hydrotreating the heavy oil to crack asphaltenes selectively and remove heavy metals such as nickel and vanadium simultaneously. The liquid products are separated into a light fraction of an asphaltene-free and metal-free oil and a heavy fraction of an asphaltene- and heavy metal-containing oil. The light fraction is recovered as a product and the heavy fraction is recycled to the hydrotreating step. Catalytic conversion of Canadian heavy bitumen (API gravity<10) using this '636 process is a high-intensity process that tends to have reliability issues with rapid catalyst deactivation impacting selectivity and yield.

In U.S. Pat. No. 4,428,824, a solvent deasphalting unit is installed upstream of a visbreaking unit to remove the asphaltenes from the visbreaking operation. In this configuration, the visbreaking unit can now operate at higher temperatures to convert the heavier molecules to lighter hydrocarbon molecules without fouling, since the asphaltenes are removed from the product stream entirely. However, the yield of the bitumen is greatly reduced (by 10-15%) since the early removal of the asphaltenes in the process prevents thermal conversion of this portion of the crude into a refinable product.

As in U.S. Pat. No. 4,428,824, U.S. Pat. No. 6,274,032, disclosed a process for treating a hydrocarbon feed source comprising a fractionator to separate the primary crude components, followed by a Solvent Deasphalting (SDA) unit to work on the heavier crude asphaltene rich component, and a mild thermal cracker for the non-asphaltene stream. The asphaltene rich stream is processed in a gasification unit to generate syngas for hydrogen requirements. Placing an SDA unit upstream of a thermal cracker reduces the overall yield of the bitumen as refinery feed, since the asphaltene portion of the crude, comprising up to 15% of Canadian bitumen, is removed from consideration for inclusion in some format as crude. This loss in product yield is not compensated for by the increased cracking in the visbreaker.

In U.S. Pat. No. 4,686,028 a process for the treatment of whole crude oil is disclosed, the process comprising the steps of deasphalting a high boiling range hydrocarbon in a two-stage deasphalting process to produce separate asphaltene, resin, and deasphalted oil fractions, followed by upgrading only the resin fraction by hydrogenation or visbreaking. The U.S. Pat. No. 4,686,028 invention applies visbreaking to a favourable portion of the whole crude stream to minimize coke generation. However, PAT '028 is limited by missing a large part of the crude that could benefit from optimal conversion and thus a large portion of the crude does not end up as pipeline product without the need of transport diluent.

In U.S. Pat. No. 5,601,697 a process is disclosed for the treatment of topped crude oil, the process comprising the steps of vacuum distilling the topped crude oil, deasphalting the bottoms product from the distillation, catalytic cracking of the deasphalting oil, mixing distillable catalytic cracking fractions (atmospheric equivalent boiling temperature of less than about 1100 degrees F.) to produce products comprising transportation fuels, light gases, and slurry oil. U.S. Pat. No. '697 is burdened by the complexity, cost, and technical viability of vacuum distilling a topped heavy crude to about 850° F. and catalytic cracking the deasphalted oil to produce transportation fuels.

In U.S. Pat. No. 6,533,925, a process is described involving the integration of a solvent deasphalting process with a gasification process and an improved process for separating a resin phase from a solvent solution comprising a solvent, deasphalted oil (DAO) and resin. A resin extractor with the solvent elevated in temperature above that of the first asphaltene extractor is included in the '925 invention. The asphaltene stream is treated but removed prior to any thermal conversion eliminating the possibility of obtaining a value uplift into useable refinery feedstock. The impact is a reduction in the overall yield of the crude stream.

In U.S. Patent application 2007/0125686, a process is disclosed where a heavy hydrocarbon stream is first separated into various fractions via distillation with the heavy component sent to a mild thermal cracker (visbreaker). The remaining heavy liquid from the mild thermal cracker is solvent deasphalted in an open art SDA unit. The asphaltenes separated from the SDA are used as feed to a gasifier. The deasphalted oil is blended with the condensed mild thermal cracker vapour to form a blended product. As stated with Pat '023 above, visbreaking faces the challenges of early coke generation. Specifically, the '686 patent application explains that the intent of this mild thermal cracker is to crack the non-asphaltene material exclusively, which is also not practical with Canadian bitumen. In addition, additional energy is required in the distillation steps with most of the separated components recombined for pipeline transport.

SUMMARY OF THE INVENTION

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly the drawings and detailed description are to be regarded as illustrative in nature and not as restrictive.

Essentially, an improved process for producing a pipeline-ready crude and refinery feedstock from heavy crude oils, such as Canadian Oil Sands bitumen, is described, with said process consisting of: (1) optimal asphaltene conversion with minimum coke and offgas make, in a full bitumen stream, within a reactor to produce a thermally affected asphaltene-rich fraction, a minimum non-condensable vapour stream and an increased refinery-feed liquid stream; (2) deasphalting said thermally affected asphaltene-rich fraction into a refinery-feed liquid stream and a concentrated asphaltene stream; (3) Selectively treating specific hydrocarbon components as required for pipeline specification and, finally blending of all the liquid streams to produce a refinery feed; and (4) flash drying of the concentrated asphaltene stream for conversion in a gasifier or asphalt plant.

The bitumen is thermally treated to remove and convert/crack selected asphaltenes, which are then sufficiently separated in a more efficient solvent extraction process, reducing production of coke and isolating undesirable contaminants (like metals, MCR, and remaining asphaltenes).

Considering the relative complexity and high degree of side chains on the Canadian bitumen asphaltenes, under the operating conditions of the invention disclosed here (optimally targeted asphaltene conversion reactor—30), the side chains are preferentially cleaved from the core asphaltene molecule to make desired vacuum gas oil to light hydrocarbon range components. The remaining polyaromatic asphaltene cores separate more readily than non-thermally affected asphaltenes resulting in improved separation processes, such as solvent deasphalting (50).

Further, the heavier hydrocarbons in the bitumen are also mildly cracked to vacuum gas oil, gasoline and distillate boiling range components, all desirable for separation and conversion in refineries. Any major deviations in temperature and heat flux within the bitumen pool in the reactor will lead to coking and increased gas yield and a reduction in the overall crude yield of the original bitumen, and reduced reliability of the operation, increasing the operating cost of the facility.

The invention provides improved apparatus and method for producing a pipeline-ready and/or refinery-ready feedstock from heavy, high asphaltene crudes (for example, Canadian bitumen), the process and apparatus comprising a pre-heater for pre-heating a process fluid to a design temperature at or near the desirable operating temperature of a reactor; moving the process fluid into a reactor for conversion of the process fluid by controlled application of heat to the process fluid in the reactor so that the process fluid maintains a substantially homogenous temperature throughout the reactor to produce a stream of thermally affected asphaltene-rich fractions, and a stream of liquid hydrocarbon vapour with minimal non-condensable vapour. The stream of vapour is separated into two further streams: of non-condensable vapour, and of light liquid hydrocarbons. The thermally affected asphaltene-rich fraction is deasphalted, using a solvent extraction process, into streams of heavy deasphalted oil liquid, and concentrated asphaltene, respectively. The deasphalted oil liquid and the light liquid hydrocarbons produced in the processes are blended to form a pipeline and refinery-ready feedstock.

A sweep gas can be deployed in the reactor, and can be preheated to provide a heat flux source other than the reactor's heaters; similarly, the sweep gas assists in the removal of reactor vapour products.

Deasphalting can be achieved using an open-art solvent extraction process; since the initial process fluid has been separated so that only the heavy asphaltene-rich fractions require deasphalting, extraction processes using high solvent-to-oil ratios are feasible and economical. Improved solvent-extraction performance, using lower solvent to oil ratios and improved DAO yield can be achieved by further concentrating the asphaltene rich fraction before a final extraction step. The process improves on open-art solvent deasphalting utilizing an additional solvent extraction column (rinse column) operating on the asphaltene-rich stream from the primary solvent extraction column to increase pipeline crude recovery and quality.

The SDA process may allow for some portion of the heavy asphaltene-rich hydrocarbon stream to be recycled and blended with the fresh feed to the reactor.

BRIEF DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein:

FIG. 4 is a table reflecting the distillation analysis for various crudes including Process 10 Product.

UNITS, STREAMS AND EQUIPMENT IN THE FIGURES

The lists of Units, Process Streams and Equipment elements provided below are indexed to numbered components in the Figures, and are provided for the readers' reference.

Figure 1:
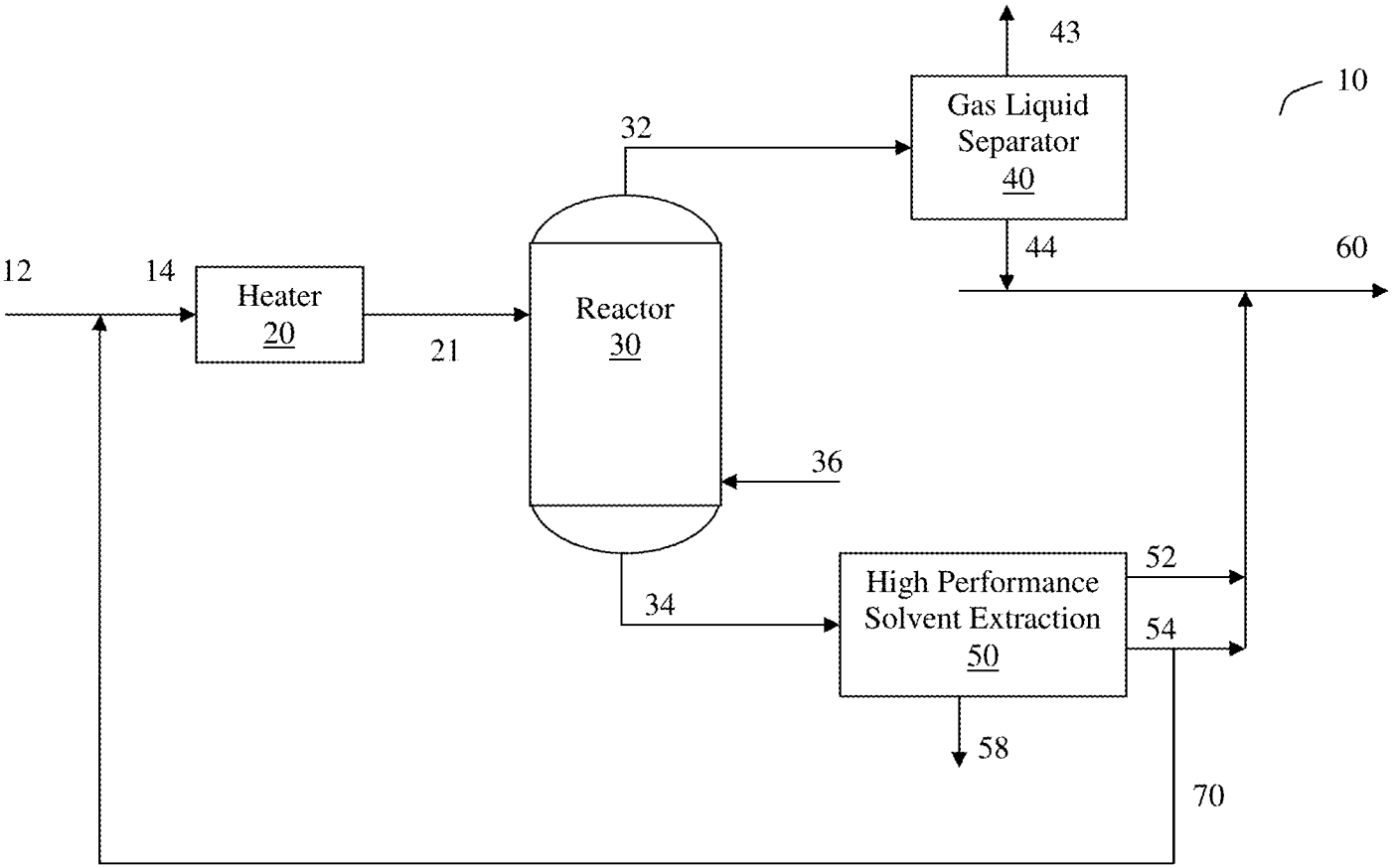
FIG. 1 is a process diagram for forming a pipeline transportable hydrocarbon product from a heavy hydrocarbon feedstock.
Figure 2:
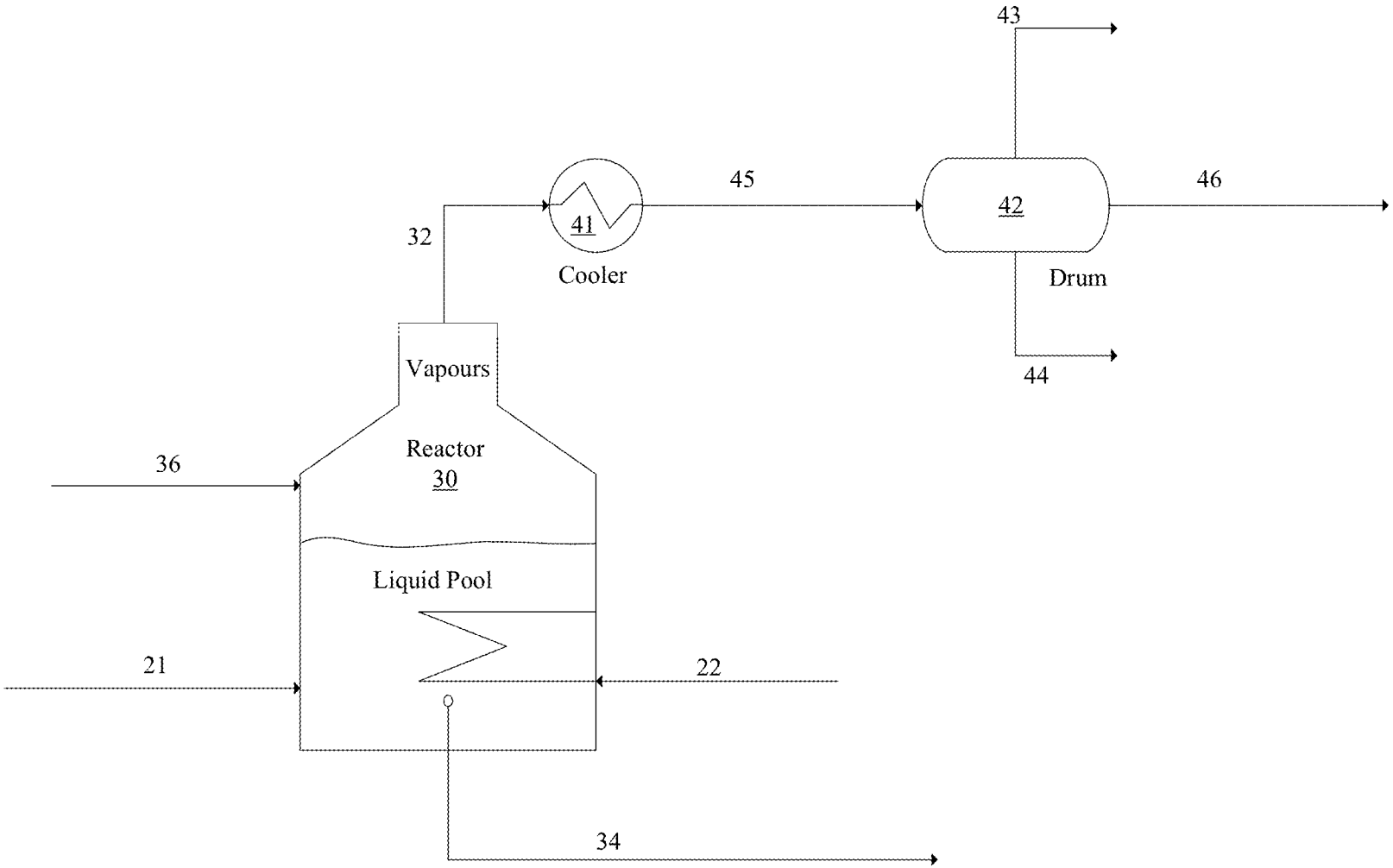
FIG. 2 is a process diagram pertaining specifically to a cracking process and liquid separation process.
Figure 3:
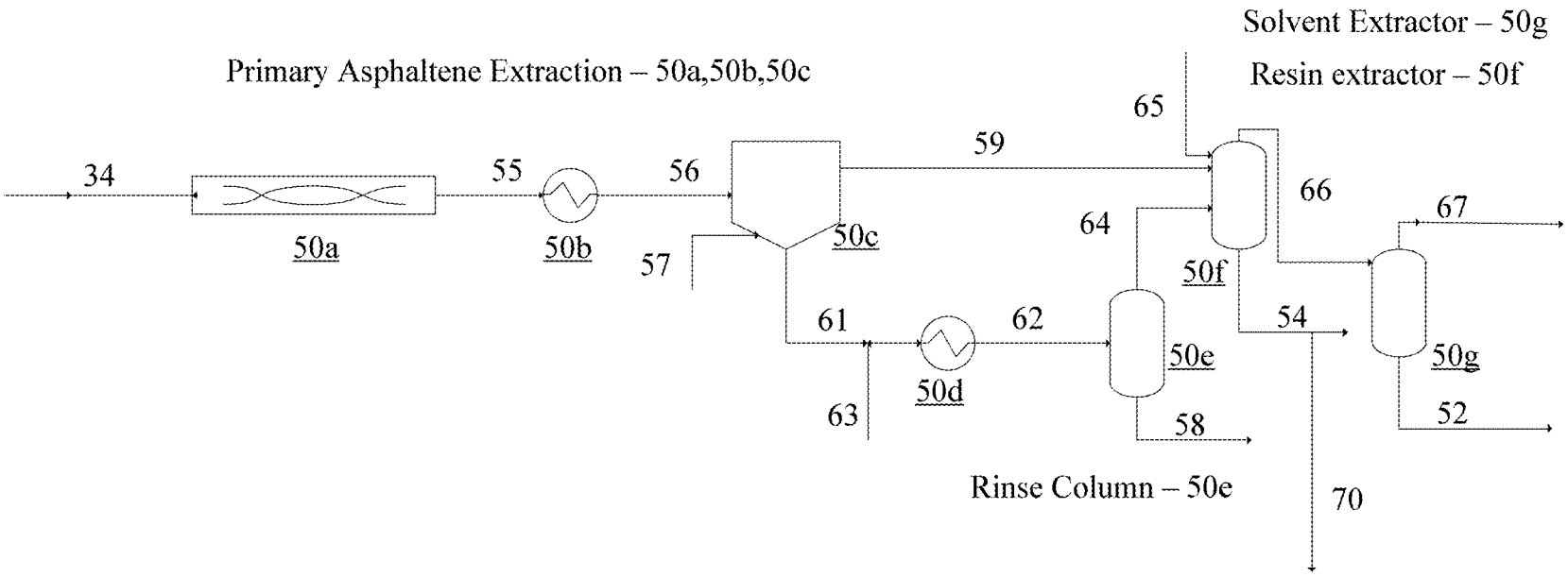
FIG. 3 is a process diagram for an exemplary solvent de-asphalting process.

Units in FIG. 1
10=Process
20=Feed Heater
30=Reactor
40=Gas Liquid Separator
50=High Performance Solvent Extraction
Streams in FIG. 1
12=Fresh Bitumen Feed
14=Complete feed to heater
21=Feed to Reactor
32=Reactor Overhead
34=Reactor bottoms
36=Sweep Gas to Reactor
43=non-Condensable vapour
44=Light hydrocarbon liquid from 40
52=DAO
54=Resin
58=Asphaltene Rich Stream
60=Product
70=Resin Recycle
Units in FIG. 2
30=Reactor—Optimal Asphaltene Conversion Unit—
41=Overhead Condenser
42=Vapour/Liquid Separator
Streams in FIG. 2
21=Feed to Reactor
22=Energy/Heat addition to Reactor
32=Reactor Overhead
34=Reactor bottoms
36=Sweep Gas to Reactor
43=non-Condensable vapour
44=Light hydrocarbon liquid from 42
45=Feed to vapour/liquid separator 42
46=Light, light hydrocarbon liquid from 42
Equipment in FIG. 3
50*a*=pipe with static mixers (co-current primary extractor)
50*b*=cooler
50*c*=clarifier/settler
50*d*=heater
50*e*=rinse column (secondary asphaltene extractor)
50*f*=resin extractor
50*g*=solvent extractor
Streams in FIG. 3
34=Feed to SDA unit from reactor bottoms
52=DAO to product blending
54=resin bottoms product to solvent extraction
55=outlet of co-current pipe/static mixers
56=feed to clarifier
57=solvent addition
58=Asphaltene-Rich stream
59=clarifier overhead to resin column
61=clarifier bottoms to rinse column
62=feed to rinse column
63=make-up solvent
64=rinse overhead outlet to resin column
65=make-up solvent
66=resin extractor overheads to solvent extractor (50*g*)
67=Recovered solvent for reprocessing

DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

FIG. 1 is a process flow diagram depicting a process 10 for forming a hydrocarbon product 60 from a hydrocarbon feedstock 12, where the final hydrocarbon product 60 has sufficient characteristics to meet minimum pipeline transportation requirements (minimum API gravity of 19) and/or is a favourable refinery feedstock. A process fluid 14 formed from a feedstock 12 of heavy hydrocarbon can be routed through a heater 20 to heat the process fluid 14 to a desired temperature level before it is routed to a reactor 30 where the process fluid 14 is controlled and maintained while it undergoes a mild controlled cracking process. After the mild cracking process, a light top fraction 32 can be routed from the reactor 30 to a gas liquid condensing separator process 40 and a heavy bottom fraction 34 can be routed to a high performance solvent extraction process 50. Some of the outputs 44 from the gas liquid separation process 40 can be blended with some of the outputs 52, 54 of the high performance solvent extraction process 50 to result in a hydrocarbon product 60 that has sufficient physical characteristics to enable it to meet the required pipeline transport criteria without having to mix the final hydrocarbon product 60 with diluents from external sources, or requiring much reduced volumes of such diluent.

The feedstock 12 can be a heavy hydrocarbon, such as the heavy hydrocarbon obtained from a SAGD (steam assisted gravity drainage) process, for example Canadian Oil sands bitumen, or from any other suitable source of heavy hydrocarbon. In one aspect, the feedstock 12 can have an API gravity in the range of 0 to 14.

In one aspect, a recycled portion 70 of the resin stream 54 output from the high performance solvent extraction process 50 can be blended with the incoming feedstock 12 to form the process fluid 14 that passes through process 10. The resin stream may be added to the process fluid in instances in which further crude yield, and/or lighter crude, and/or asphaltene suppression is desired in order to meet treated product characteristic targets. The resin recycle provides the operator with flexibility, through an adjustable flow parameter, to meet production specifications, and allows the plant to handle feedstock variations robustly.

The resin product 54 from the solvent extraction process 50 will typically have a relatively low API gravity. In one aspect, the API gravity of the resin product 54 can have an API gravity between 0 and 10. Depending on the characteristics of the feedstock 12 and the amount of resin product 54 blended with the feedstock 12, the resulting process fluid 14 can have a range of characteristics and particularly a range of API gravities.

The process fluid 14 (obtained entirely from the feedstock 12 or formed as a blend of feedstock 12 and resin product 54 from the solvent extraction process 50) can be routed to the heater 20 where the process fluid 14 can be heated to a desired temperature as it passes through the heater 20 before being routed to the reactor 30 to undergo mild thermal cracking. Reactor 30 maintains a consistent fluid temperature through a uniform application of heat through-out the reactor to allow for mild thermal cracking to occur without coking being a concern or detrimental to the operation and/or performance of the reactor.

In one aspect, the heater 20 will heat the process fluid 14 to a temperature between 675-775° F. before the process fluid 14 is introduced into the reactor 30.

In the reactor 30, the process fluid 14 (heated to between 675-775° F. by the heater 20) undergoes a mild controlled cracking process. Appropriately located heaters are provided to maintain the desired constant temperature generated in heater 20 and to apply uniform heat flux for the fluid 14 in this reactor 30. The heaters provide heat through any source readily available (electric, heat transfer fluid, radiant etc.).

The reactor 30 can be operated in a manner, through optimizing primarily five inter-related process variables (Heat Flux Temperature, Residence Time, Pressure and Sweep Gas), so as to reduce or even prevent coke from forming during the reaction, and minimizing gas production, while also providing optimal conversion of the asphaltene portion of the heavy hydrocarbon to refinery-ready feedstock components.

The first and second variables involve applying a uniform heat flux between 7000-12000 BTU/hr sq.ft to the entire pool of process fluid in the reactor and maintaining a single operating temperature in the reactor between 675-775° F. This may be achieved by the presence of appropriately sized and located heating devices in the reactor. In an embodiment, the number of heaters will be set by calculating the optimal dispersion of heat between any two heaters so as to have a uniform temperature throughout the pool and to avoid peak or spot temperatures significantly higher than the target temperature in the reactor.

The third reactor variable, residence time, can be between 40-180 minutes in the reactor.

The fourth reactor variable, operating pressure, can be maintained at near atmospheric pressure, in any case, to be less than 50 psig, with standard pressure control principles used for consistent performance. The pressure range is controlled on the low end to prevent excessive, premature flashing of hydrocarbon, essentially bypassing the reactor, and limited on the high end to reduce secondary cracking and consequent increased gas yields.

The fifth reactor variable, hot sweep gas 36, in the same temperature range as the process fluid (675-775° F.) 21, is added to the process fluid 14 in the reactor 30 in the range of 20-80 scf/bbl.

The sweep gas 36 can be natural gas, hydrogen, produced/fuel gas from the process, steam, nitrogen or any other non-reactive, non-condensable gas that will not condense to a liquid.

Sweep gas in the dosage of 20-80 scf/bbl of feed is provided to remove the "lighter" hydrocarbon products (i.e. methane to <750° F. boiling point hydrocarbons) as soon as they are formed in the reactor 30 so that there is a minimum of secondary cracking which could increase gas make and potentially increase olefinic naphtha/distillate production.

The sweep gas may also allow the reactor to operate closer to the desired operating pressure (<50 psig) and temperature. The sweep gas 36 can also be used to provide additional heat to the process fluid 14 in the reactor 30.

As discussed with respect to FIGS. 1 and 2, the heat energy stream 22, for reactor 30 is uniformly (7000-12000 BTU/hrsq.ft) applied throughout the hydrocarbon residence time (40-180 minutes) in the reactor at the desired temperature (675-775° F.) and pressure (less than 50 psig) to minimize any local peak fluid temperatures which can initiate coking, and thereby allowing an increased thermal transfer of heat at a higher bulk temperature improving the conversion of hydrocarbons within reactor 30. At these operating conditions, the reaction kinetics favour optimum conversion of the asphaltenes that preferentially cleaves the outlying hydrocarbon chains creating desirable hydrocarbons (VGO and diesel range hydrocarbons) for the refiner without causing coking and increased gas production in the reactor. As an example, Table 4 illustrates different configurations of asphaltenes for different types of crudes. The proposed operating conditions of reactor 30 factor in the relative complexity and high degree of side chains on different crudes.

TABLE 4
Average molecular structures representing asphaltene molecules from different sources: A, asphaltenes from traditional heavy crudes; B, asphaltenes from Canadian bitumen (*Sheremata et al.*, 2004).
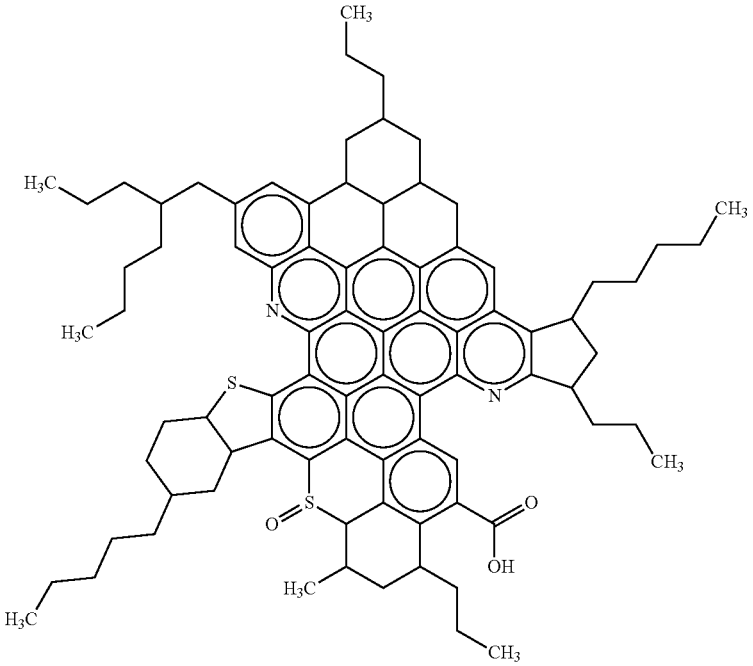
A
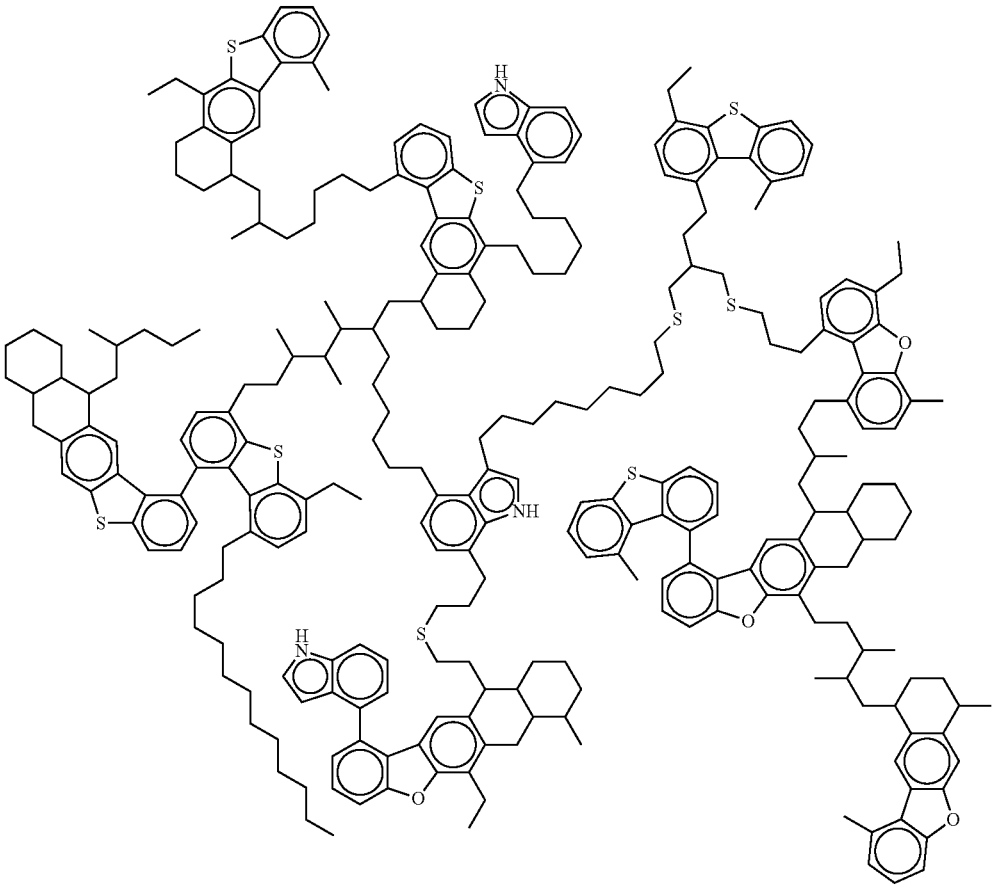
B Each variable may be changed independently, within the ranges suggested, based on the quality of feedstock provided or based on the quality of output desired. Since the 5 noted process variables are inter-related, a multi-variable process control scheme with a prescribed objective function (maximum yield to meet minimum product specifications) will be beneficial to ensure the process operates at an optimal point when any one of the variables is changed or the feed/product situation is altered.

Once the process fluid 14 has remained in the reactor 30 for a sufficient amount of time so that the characteristics of the outputs of the reactor 30 reach desired qualities, a light overhead fraction 32 and a heavy bottoms fraction 34 can be removed from the reactor 30.

The light overhead fraction 32 of the output from the reactor 30 can contain non-condensable vapor products, light liquid hydrocarbon and heavier liquid hydrocarbon. The vapor products can be vapors released from the process fluid 14, such as sour gas, while undergoing thermal cracking, as well as introduced and unconverted or unused sweep gas 36 that has passed through the reactor 30.

The overhead liquid fraction 32 will have a much higher API gravity than the bottom fraction 34. For example, the overhead liquid fraction 32 could typically have an API gravity of 26 or greater. The overhead fraction 32 can be directed to a gas liquid separation unit 40, which can comprise a cooler 41 and separation drum 42, as an example, in which a portion of the overhead fraction 32 that is a condensable liquid product containing naphtha and heavier hydrocarbons can be separated from the gaseous components of the overhead fraction 32. An off-gas line 43 containing undesirable gases such as sour gas, can be removed at the separation drum 42 to be disposed of, recycled, or subjected to further treatment.

One or more liquid hydrocarbon streams can be produced from separation drum 42. Stream 44, a heavier hydrocarbon than stream 46, can be sent to product blending, while stream 46 can be considered for further bulk hydro-treating prior to product blending.

The bottom fraction 34 can contain hydrocarbons, and modified asphaltenes. Although the characteristics of the bottom fraction 34 taken from the reactor 30 will vary depending on the process fluid 14 input into the reactor 30 and the reactor's operating parameters, in one aspect the bottom fraction 34 can have an API gravity ranging between −5 and 5.

Controllable process variables allow an operator to vary the performance of the reactor 30 to meet the needs of the final product based on any changing characteristics of the incoming process fluid 14. The controllability of the five inter-related variables, residence time, sweep gas, heat flux, temperature and pressure in the reactor 30 allow an operator to vary the performance of the reactor 30. In this manner, when the characteristics of the feedstock 12 are changed either as fresh feed or resin recycle 70, the five inter-related process variables can be optimized to avoid the production of coke and minimize the production of non-condensable vapors which are produced in the reactor 30. For example, the operator can vary the residence time of the process fluid 14 in the reactor 30 based on the characteristics of the process fluid 14 to obtain the desired yields and/or quality of the outputs 32, 34. Alternatively, the operator can vary the sweep gas, temperature or pressure to achieve similar outcomes. The process variables are inter-related and the minimization of coke and avoidance of excess gas make is challenging and is best determined by pilot operations.

The bottom fraction 34 from the reactor 30 can be fed to a high performance solvent extraction process 50 that can produce a thermally affected asphaltene stream 58, an extracted oil stream 52 and a resin stream 54. The reactor 30 is operated in a manner that significantly limits and even prevents the formation of coke and reduces gas production while converting asphaltenes into more suitable components for downstream processing. Consequently, modified asphaltenes and other undesirable elements remain in the bottom fraction 34 that is removed from the reactor 30.

To maximize the recovery of the desirable refinery feedstock crude the undesirable elements that remain in the bottom fraction 34, the bottom fraction 34 from the reactor 30 must be further treated using, for example, a high performance solvent extraction process 50. The treatment of the bottom fraction 34 by solvent extraction process 50 allows the reactor 30 and the solvent extraction process 50 to be used in conjunction, to produce a suitable full range refinery feedstock crude.

The solvent extraction process 50 can comprise any suitable solvent extraction process. In one aspect, it can be a three stage super-critical solvent process that separates the asphaltenes from the resins in the bottom fraction 34. The output of the solvent extraction process 50 can be an asphaltene stream 58, an extracted oil stream 52 and a resin stream 54. The asphaltene stream 58 is typically undesirable and is removed from the process 10. The extracted oil stream 52 can be of a relatively high quality, with an API gravity range of 9 to 15. The resin stream 54 is typically of a lower quality than the extracted oil stream 52, with an API gravity lower than the extracted oil stream 52. In one aspect, the resin stream 54 can have an API gravity in the range of 0 to 10 API gravity.

The extracted oil stream 52 and the resin stream 54 from the solvent extraction process 50 can be blended along with the liquid product stream 44 obtained from the liquid gas separator 40 to form a final hydrocarbon product 60 meeting the specifications of the pipeline and/or refinery-ready. In one aspect, this final hydrocarbon product 60 would have an API gravity greater than 19. Typically, the final hydrocarbon product 60 would have a viscosity of 350 CentiStokes ("cSt") or less.

The resin stream 54 is typically of a lesser quality than the extracted oil stream 52. The recycle portion 70 of the resin stream 54 can be blended with the feedstock 12 to be reprocessed in order to form the final hydrocarbon product 60. As a result, this recycling portion of the resin stream will improve the quality of the final hydrocarbon product 60.

In another aspect, to increase overall recovery of product hydrocarbon from reactor 30 and reduce solvent circulation rates, a high-performance solvent extraction process 50 may include a supplemental extraction process step, rinse column **50*e*, upstream of the asphaltene stream 58. Instead of sending stream 61, the bottoms of the primary extractor 50*c*, to an asphaltene stripper or spray dryer as is the case in conventional SDA units known in the art, stream 61 can be sent to a secondary solvent extraction column. Conventionally, additional solvent extraction is performed on the primary deasphalted oil, in the form of a resin extractor 50*f*, to provide a separate deasphalted heavy oil stream 66. The additional solvent extraction step on the asphaltene-rich stream by rinse column 50*e* as shown in FIG. 3 uses standard liquid-liquid extraction with the same solvent used in the primary extractor. The placement of this standard liquid-liquid column on the asphaltene-rich stream is unique and is beneficial, since the solvent to oil ratio can be economically increased within this column up to 20:1 to increase the recovery of deasphalted oil, while the overall solvent use is reduced. Solvent in stream 63 is added to the asphaltene-rich stream 61 to a very high solvent to oil ratio and is cooled further to enhance asphaltene precipitation and thus oil recovery within column 50***e*. The deasphalted oil stream 64, is sent to the resin extractor 50*f*, to be further refined for product blending. The bottoms stream from the rinse column 50*e* becomes stream 58, and is sent for solvent recovery via distillation, stripping or flash drying.

Overall solvent use to achieve high hydrocarbon recovery in stream 60 can be 25% less than using comparable open art processes. To obtain desired yields of 99+% DAO (deasphalted oil) recovery in stream 60 while still meeting pipeline and refinery specifications, typical 3-stage extraction processes require solvent to oil ratios in the 8-9:1 range for Canadian Oil Sands bitumen (www.uop.com). As an example, for a 60,000 BPD bitumen flow, the minimum solvent needed is 480,000-540,000 BPD. Using the rinse column 50*e* arrangement helps to reduce the total solvent circulated since the process step specifically targets the molecules (asphaltenes) that need to be separated from the desired crude (heavy oil). A solvent-to-oil ratio of 3-4:1 in the main extractor 50*a.b.c* is only needed (240,000 BPD) to precipitate all of the thermally affected asphaltenes with minimum DAO entrainment. The rinse column, 50*e*, will have a feed of approximately 6,000 BPD of asphaltene-based components and 750-1000 BPD of crude. A solvent to oil ratio of 15-20:1 in the rinse column 50*e* would extract the remaining crude requiring up to 140,000 BPD of additional solvent. The total solvent circulated is 380,000 BPD with the rinse column configuration shown as 50*e*, resulting in a 25% reduction in the amount of solvent circulated. The result is a significant reduction in energy consumption compared to a prior art 3-stage extraction process. This high performance solvent extraction scheme, including column 50*e*, can be applied to an existing open-art solvent extraction scheme in operation to further increase crude yield and/or reduce operating costs by reducing total solvent circulation. In another aspect, the new scheme can be used as an improvement to designs in heavy oil recovery that would normally use prior art solvent deasphalting.

The resulting asphaltene stream 58 can be processed in a 20% smaller asphaltene drying unit. The core portion of the remaining dried asphaltenes tend to be less sticky, with side chains removed, resulting in less volume required to flash dry. In addition, the modified nature of the asphaltenes provides for the opportunity for more effective metals reclamation and better feedstock for a clean energy conversion technology (e.g. gasification, catalytic gasification, oxy-combustion for enhanced SAGD production).

Process 10 provides a crude feedstock that is pipeline compliant and is optimal for high conversion refiners. Stream 60 has low metals (<20 wppm Ni+V), low asphaltenes (<0.3 wt %), a very low TAN number (<0.3 mg KOH/mg) no diluent, and is high in VGO range material (30-50% of crude). For high conversion refiners (>1.4:1 conversion to coking), the distillation quality of the crude produced in stream 60 will improve utilization of the highest profit-generating units while filling out the remaining units. FIG. 4 shows the distillation curve of a representative feedstock (dilbit) and the produced refinery-ready feedstock which is a well-balanced crude when compared to other heavy refinery feedstock crudes such as WCS (Western Canada Select). WCS has more residual requiring intense conversion and more light material than refiners can profitably refine to transportation fuels.

The combination of reactor 30 and the high performance solvent extraction process unit 50, exhibits a reduced process complexity. This may be expressed as a Nelson complexity index value of 4.0-4.5, significantly less than 9.0-10.0 for a coking and/or hydroprocessing scheme. Another illustration of improved performance is the reduced energy requirement of 3.93 GJ/tonne feed when compared to a delayed coking process that requires an energy input of 4.70 GJ/tonne feed to operate. This is a 16.4% reduction in energy intensity. This corresponds to a specific greenhouse gas (GHG) output of 0.253 tonne CO2/tonne feed for the Delayed Coking process and 0.213 tonne CO2/tonne feed for the proposed process. On a product comparison basis, the energy reduction is approximately 25-27% versus a coking process.

When compared to a coking upgrading process and standard reactor and solvent extraction process, process 10 provides a significant improvement in yield by minimizing by-products (Coke and non-condensable hydrocarbons) as noted in Table 6.

TABLE 6

Product (stream 60) yield comparison

| | Volume % | Mass % |
|---|---|---|
| Coking | 80-84 | 78-80 |
| Standard reactor/solvent extraction process | 86 | 80-82 |
| Process 10 | >88 | 83-85 |

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

What is claimed:

1. Process apparatus for processing heavy hydrocarbons to produce pipeline-ready or refinery-ready feedstock, comprising:

a) a process fluid preparation component for mixing heavy hydrocarbon with other substances as required to prepare a process fluid;

b) transport means to move the process fluid to a pre-heater;

c) The pre-heater capable of heating the process fluid to a temperature close to or at a desired operating temperature of a reactor;

d) transport means to move the heated process fluid to the reactor;

e) the reactor having heat exchange means to provide a desired heat flux to the process fluid and maintain the process fluid in-reactor at a substantially uniform desired temperature for a desired residence time;

f) means to provide sweep gas to the process fluid in the reactor;

g) means to remove various produced fluids from the reactor at the end of the residence time, those fluids comprising at least:

i. -non-condensable vapors;

ii. -light liquid hydrocarbons;

iii. -thermally-affected asphaltene-rich fractions;

h) means to separate non-condensable vapours from light liquid hydrocarbons;

i) transport means to move the thermally affected asphaltene-rich fractions to a solvent extraction processor;

j) the solvent extraction processor, with means to remove extracted products from the thermally affected asphaltene-rich fractions, those products being:

ii. deasphalted oils;

iii. resins;

iv. concentrated asphaltene;

k) means to collect the deasphalted oils, resins and the light liquid hydrocarbons in appropriate quantities and blend them together to provide the pipeline-ready or refinery-ready feedstock, where the reactor is a single thermal conversion reactor with an overhead partial condenser.

2. The apparatus of claim 1 operating with uniform heat flux introduced to process fluid in the reactor between 7,000 and 12,000 BTU/hr.sq.ft.

3. The apparatus of claim 1 operating with sweep gas introduced within the reactor.

4. The apparatus of claim 1 where the ratio of sweep gas to process fluid is between 20 and 80 scf/bbl.

5. The apparatus of claim 1 where the sweep gas is at least one of: nitrogen, steam hydrogen or light hydrocarbon such as: methane, ethane, or propane.

6. The apparatus of claim 1 with a heater to heat the sweep gas prior to introduction to the reactor.

7. The apparatus of claim 1 operating with residence times for process fluid in reactor between 40 and 180 minutes in duration.

8. The apparatus of claim 1 providing substantially uniform temperatures for the process fluid in the reactor between 675 and 775 degrees Fahrenheit.

9. The apparatus of claim 1 with the process fluid in the reactor being at or near atmospheric pressure.

10. The apparatus of claim 1 operating at pressures below 50 psig.

* * * * *